US008360427B2

(12) United States Patent
Cha et al.

(10) Patent No.: US 8,360,427 B2
(45) Date of Patent: Jan. 29, 2013

(54) MEDIUM TRANSFER APPARATUS FOR AN AUTOMATED TELLER MACHINE

(75) Inventors: Jin Hwan Cha, Seoul (KR); Sung-Chang Hur, Seoul (KR); Hyun-Soo Jang, Seoul (KR)

(73) Assignee: Nautilus Hyosung Inc., Seoul (KR)

( * ) Notice: Subject to any disclaimer, the term of this patent is extended or adjusted under 35 U.S.C. 154(b) by 0 days.

(21) Appl. No.: 13/142,270

(22) PCT Filed: Dec. 23, 2009

(86) PCT No.: PCT/KR2009/007698

§ 371 (c)(1), (2), (4) Date: Jun. 24, 2011

(87) PCT Pub. No.: WO2010/077003

PCT Pub. Date: Jul. 8, 2010

(65) Prior Publication Data

US 2011/0254215 A1 Oct. 20, 2011

(30) Foreign Application Priority Data

Dec. 31, 2008 (KR) ..... 10-2008-0138205

(51) Int. Cl.
*B65H 5/02* (2006.01)

(52) U.S. Cl. ..... 271/273; 271/274; 902/15

(58) Field of Classification Search ..... 271/273, 271/274, 3.18–3.21, 3.01, 9.01, 9.13, 279, 271/292, 298, 225; 399/124; 902/8, 15; 209/534

See application file for complete search history.

(56) References Cited

U.S. PATENT DOCUMENTS

| | | | | |
|---|---|---|---|---|
| 3,661,383 | A * | 5/1972 | Morrison | 271/273 |
| 5,657,846 | A * | 8/1997 | Schwartz | 194/206 |
| 7,255,265 | B2 * | 8/2007 | VanKirk et al. | 235/379 |
| 7,263,326 | B2 | 8/2007 | Amagai | |
| 7,457,586 | B1 * | 11/2008 | Hietala et al. | 455/63.1 |
| 7,510,181 | B2 | 3/2009 | Kozaki | |
| 2002/0152167 | A1 * | 10/2002 | Kim | 705/43 |
| 2003/0038062 | A1 * | 2/2003 | Werner et al. | 209/534 |
| 2005/0029168 | A1 * | 2/2005 | Jones et al. | 209/534 |
| 2005/0191102 | A1 | 9/2005 | Amagai | |
| 2006/0071404 | A1 | 4/2006 | Kozaki | |

FOREIGN PATENT DOCUMENTS

| | | | |
|---|---|---|---|
| JP | 2005-119872 | A | 5/2005 |
| JP | 2006-062775 | A | 3/2006 |
| JP | 2007-314258 | A | 12/2007 |
| KR | 20-0411492 | Y1 | 3/2006 |

OTHER PUBLICATIONS

PCT International Search Report, with English translation, PCT/KR2009/007698, Jul. 28, 2010, 5 Pages.

PCT International Written Opinion, with English abstract, PCT/KR2009/007698, Jul. 28, 2010, 4 Pages.

* cited by examiner

*Primary Examiner* — Jeremy R Severson

(74) *Attorney, Agent, or Firm* — Fenwick & West LLP

(57) ABSTRACT

The present invention relates to a medium transfer apparatus for an automated teller machine, wherein a portion of medium transfer apparatus is opened and shut by a simple operation, thereby conveniently and quickly solving the problem of jams occurring when the medium transfer apparatus transfers a paper medium.

6 Claims, 6 Drawing Sheets

MEDIUM TRANSFER APPARATUS FOR AN AUTOMATED TELLER MACHINE

TECHNICAL FIELD

The present invention relates to a media transfer device of an automatic teller machine (ATM), and more particularly, to a media transfer device of an ATM that may readily solve a jam phenomenon occurring while the media transfer device is transferring paper media.

BACKGROUND ART

In general, an automatic teller machine (ATM) may be installed in a financial institution such as a bank and the like, to provide convenient financial services for customers without restriction on a time and an occasion. Also, the ATM may be installed in a convenient store, a public place, and the like, in addition to the financial institution. The ATM may provide a variety of financial services, for example, depositing or withdrawing of paper media such as notes and checks, checking of the balance, an account transfer, and the like. The ATM may include independently mounted various modules, for example, a depositing device, a withdrawing device, a card reader, a bankbook arrangement device, and the like. The modules may be connected to a controller and thereby, operations of the modules may be controlled by the controller.

The depositing device corresponds to a device for depositing paper media of a customer into the ATM, and the withdrawing device corresponds to a device for withdrawing paper media from the ATM for the customer. Also, a depositing and withdrawing device in which the depositing device and the withdrawing device are integrally formed may be mounted to the ATM. A media transfer device for transferring paper media may be provided in the depositing device, the withdrawing device, and the depositing and withdrawing device. Hereinafter, for ease of description, description will be made based on the media transfer device of the depositing device. However, it is only an example and thus, the description may be applicable alike to the media transfer device of the withdrawing device and the media transfer device of the depositing and withdrawing device.

Meanwhile, a jam phenomenon may occur while the media transfer device is transferring paper media. The jam phenomenon may occur due to various reasons and in general, may occur when paper media is being caught or crumpled in the media transfer device. When the jam phenomenon occurs due to such paper media, the jam phenomenon of the media transfer device may be solved by disassembling parts of the media transfer device and then removing corresponding paper media having caused the jam phenomenon.

However, in the case of the media transfer device according to a conventional art, it is difficult to verify a position in which the jam phenomenon occurs in the media transfer device. In addition, since the jam phenomenon is to be solved after disassembling the parts of the media transfer device, a corresponding work may be very inconvenient and complex. Accordingly, when the jam occurs in the media transfer device, it is impossible to solve the jam phenomenon of the media transfer device without help from an expert. In particular, since the ATM cannot be used until the jam phenomenon of the media transfer device is solved, the efficiency of the ATM may be deteriorated.

DISCLOSURE OF INVENTION

Technical Goals

An aspect of the present invention provides a media transfer device of an automatic teller machine (ATM) that may readily and quickly solve a jam phenomenon occurring while the media transfer device is transferring paper media.

Another aspect of the present invention also provides a media transfer device of an ATM that may more simplify a structure of removing a jam from the media transfer device and simply perform an operation of removing the jam.

Technical Solutions

According to an aspect of the present invention, there is provided a media transfer device of an automatic teller machine (ATM), the media transfer device including: a first transfer portion transferably supporting one surface of paper media; a plurality of second transfer portions being disposed to face the first transfer portion to transferably support another surface of paper media, and of which at least two second transfer portions are rotatably provided to open and close a portion of a media transfer path formed between the first transfer portion and the at least two transfer portions; an interoperation portion being provided to the second transfer portions to enable each of the second transfer portions to interact with each other; and a locking portion being provided to one of the second transfer portions to fix the second transfer portions when the media transfer path is closed.

Accordingly, when operating the second transfer portions after releasing a locked state of the locking portion and the first transfer portion, a portion of the media transfer path may be readily opened and jammed paper media may be readily removed through an open portion of the media transfer path. In particular, the second transfer portions may operate with each other by the interoperation portion and thus, an opening and closing operation of the media transfer path may be very simply and readily performed.

At least two of the second transfer portions may be disposed to be adjacent to each other, and one ends of the at least two second transfer portions disposed to be adjacent to each other may be disposed to be rotatable based on another ends thereof, respectively. The interoperation portion may be provided to one ends of the second transfer portions. As described above, the interoperation portion may be provided to the one ends of the at least two second transfer portions disposed to be adjacent each other and thus, may be formed in a compacter shape.

One side of the interoperation portion may be fixed to one end of the second transfer portion including the locking portion, and another side of the interoperation portion may interfere with one ends of remaining second transfer portions not including the locking portion.

Accordingly, when the media transfer path returns to its original position before opening by rotating the one end of the second transfer portion including the locking portion, the one ends of the second transfer portions not including the locking portion may interfere with the other side of the interoperation portion and thereby rotate together in the same direction as the second transfer portion including the locking portion. In particular, by providing a single locking portion to the second transfer portion fixed with the one side of the interoperation portion, all of the second transfer portions may be fixed and thus, a number of locking portions to be installed may decrease.

An elastic member may be disposed between the other side of the interoperation portion and the one ends of the second transfer portions to provide the elastic force into the direction of opening the media transfer path. A coil spring, a pan spring, a pad of elastic material, and the like, may be used for the elastic member. The elastic member may be formed to have a size enough to interfere with the other side of the interoperation portion and the one ends of the second transfer portions when the media transfer path is closed. Accordingly, when the media transfer path is closed, it is possible to prevent a gap from occurring between the other side of the interoperation portion and the one ends of the second transfer portions. It is also possible to prevent the other one side of the interoperation portion and the one ends of the second transfer portions from being damaged when opening and closing the media transfer path.

The first transfer portion and the second transfer portions may include a transfer belt and a transfer roller. The second transfer portions may rotate into a direction in which the media transfer path is to be opened by tension of the transfer belt. Specifically, since the first transfer portion and the second transfer portions are disposed in a state where the transfer belt is tense, the second transfer portions may rotate into the direction of opening the media transfer path by the tension of the transfer belt as a locked state of the locking portion is released.

The one end of the locking portion may be elastically rotatably mounted to one of the second transfer portions, and another end of the locking portion may include a stopping hook that is stopped by a stopping protrusion formed in a housing receiving the first and second transfer portions, or the first transfer portion and thereby is fixed when the media transfer path is closed. Accordingly, as the media transfer path returns to its initial state in which the media transfer path is closed, the one end of the locking portion may elastically rotate based on one end whereby the stopping hook may be automatically stopped by the stopping protrusion. Instead of the stopping protrusion, a stopping hole or a stopping groove may be formed.

Effect of the Invention

In a media transfer device of an automatic teller machine (ATM) according to embodiments of the present invention, opening and closing operations of second transfer portions may be performed together using an interoperation portion and thus, it is possible to simply open and close a media transfer path with a single operation and to readily and quickly solve a jam phenomenon occurring while the media transfer device is transferring paper media.

Also, according to embodiments of the present invention, since one side of the interoperation portion is fixed to one end of any one of the second transfer portions and another side of the interoperation portion is fixed to one ends of remaining second transfer portions so that they may interfere with each other, the second transfer portions and the interoperation portion may be provided in a very simple structure and thereby be configured in the media transfer device using a relatively small cost and a small number of parts.

Also, according to embodiments of the present invention, when a locking portion is mounted to the second transfer portion including the interoperation portion, it is possible to lock operations of the second transfer portions using the single locking portion. Accordingly, since there is no need to install a number of locking portions corresponding to a number of second transfer portions, it is possible to decrease a number of parts and a part cost.

Also, according to embodiments of the present invention, the elastic member may be disposed between one ends of the second transfer portions and the other side of the interoperation portion to provide the elastic force into the direction in which the media transfer path is opened when the media transfer path is closed. Accordingly, it is possible to prevent a gap from occurring between the other side of the interoperation portion and the one ends of the second transfer portions. It is also possible to prevent damage from collision between the one side of the interoperation portion and the one ends of the second transfer portions when opening and closing the media transfer path.

BEST MODE FOR CARRYING OUT THE INVENTION

Figure 1:
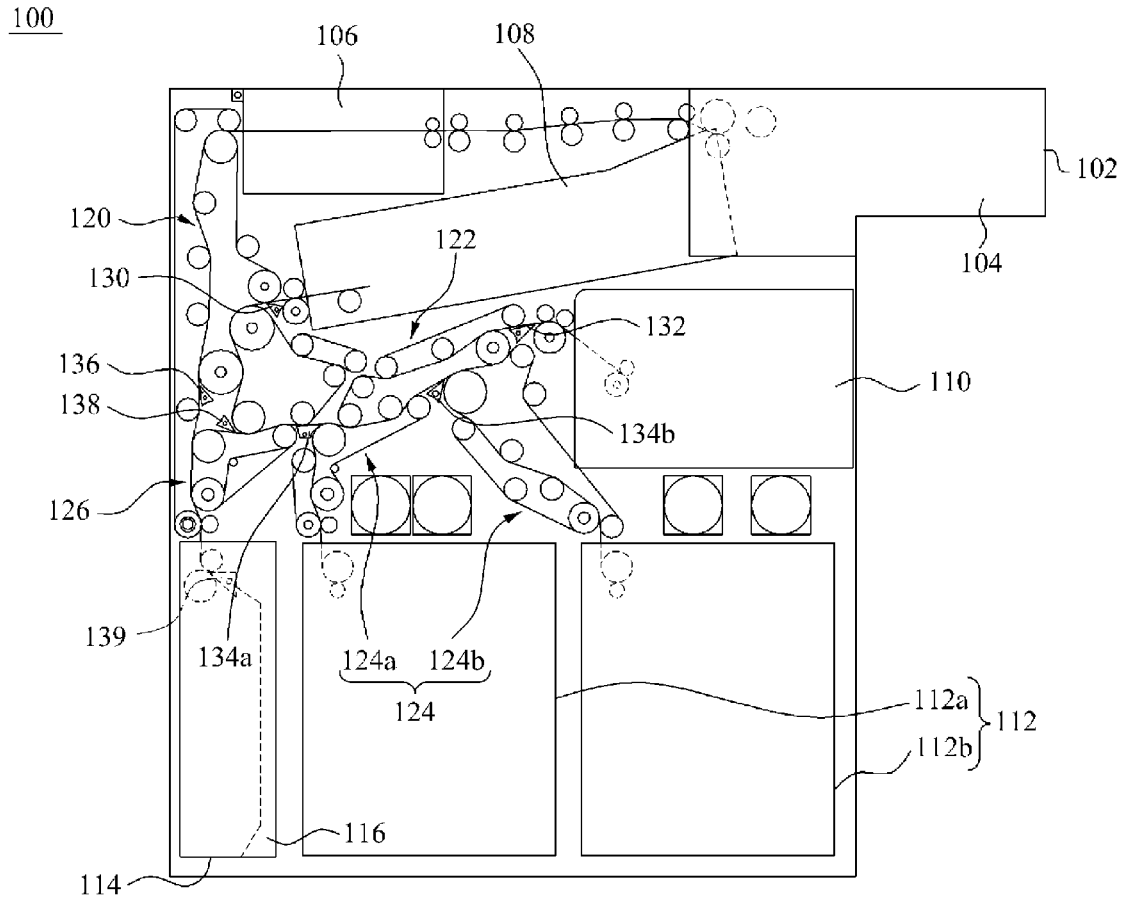
FIG. 1 is a sectional view illustrating a depositing device of an automatic teller machine (ATM) including a media transfer device according to an embodiment of the present invention.

Reference will now be made in detail to embodiments of the present invention, examples of which are illustrated in the accompanying drawings, wherein like reference numerals refer to the like elements throughout. The embodiments are described below in order to explain the present invention by referring to the figures.

Hereinafter, a media transfer device of an automatic teller machine (ATM) according to an embodiment of the present invention will be described.

Figure 2:
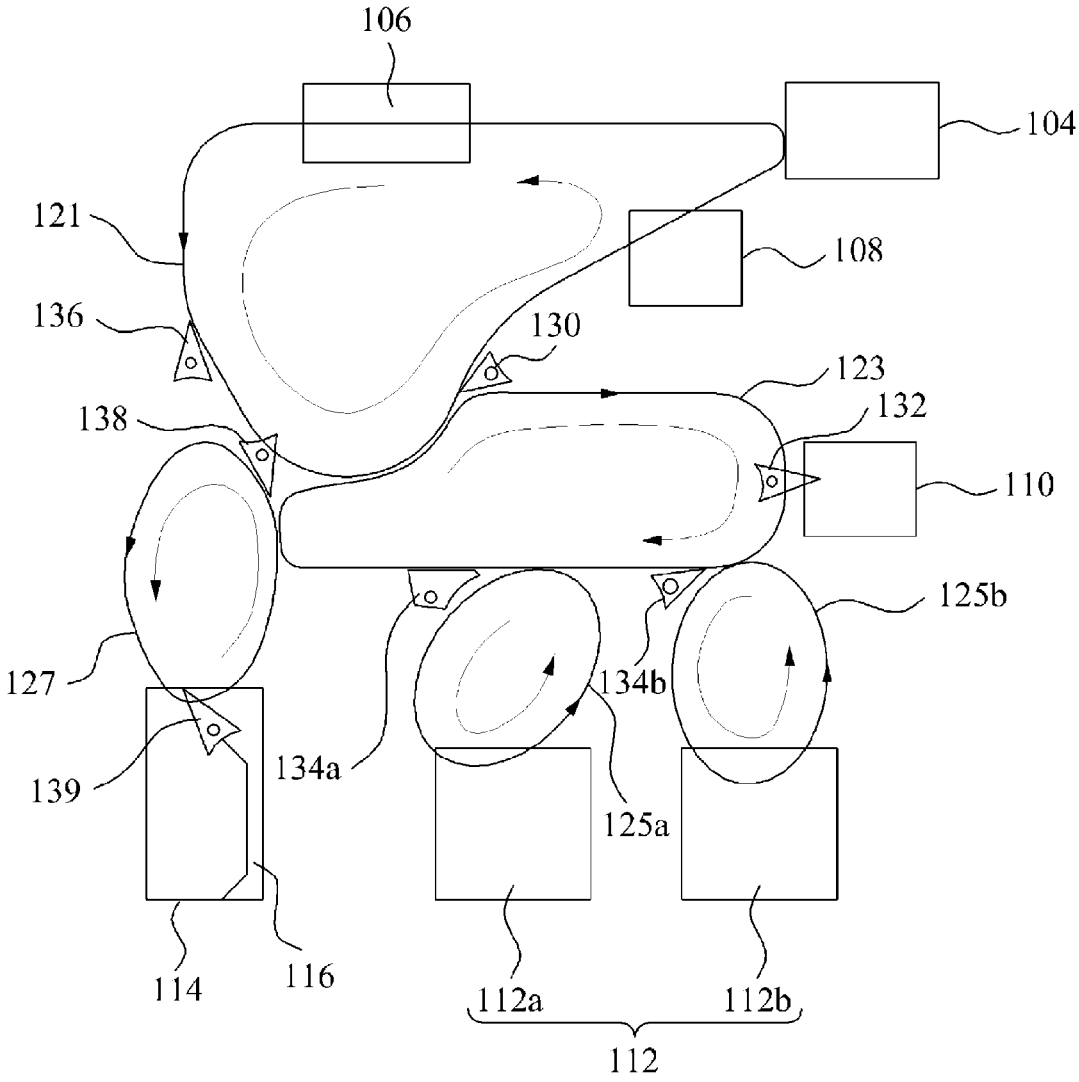
FIG. 2 is a view illustrating a media transfer path of FIG. 1.
Figure 3:
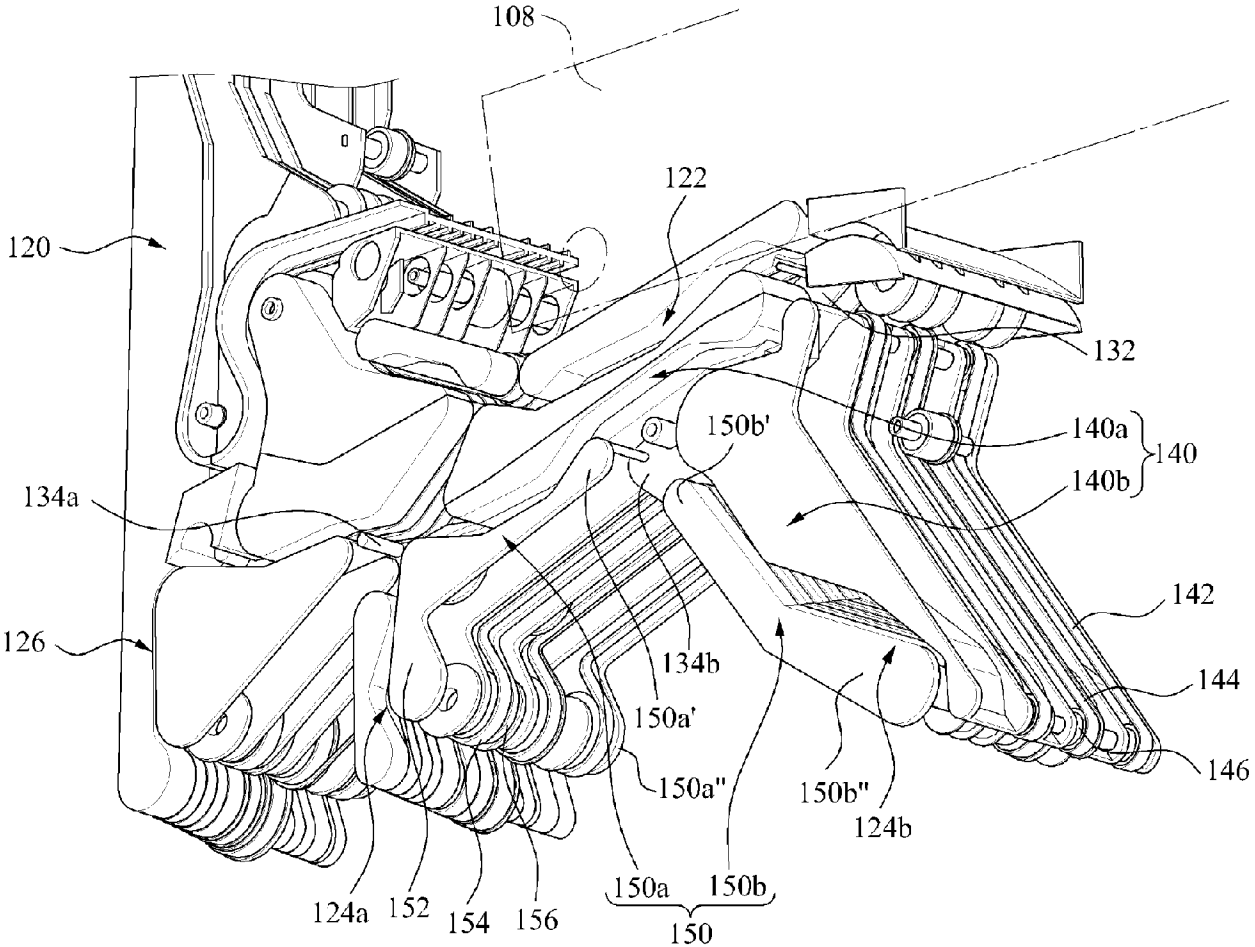
FIG. 3 is a perspective view illustrating major components of the ATM of FIG. 1.
Figure 4:
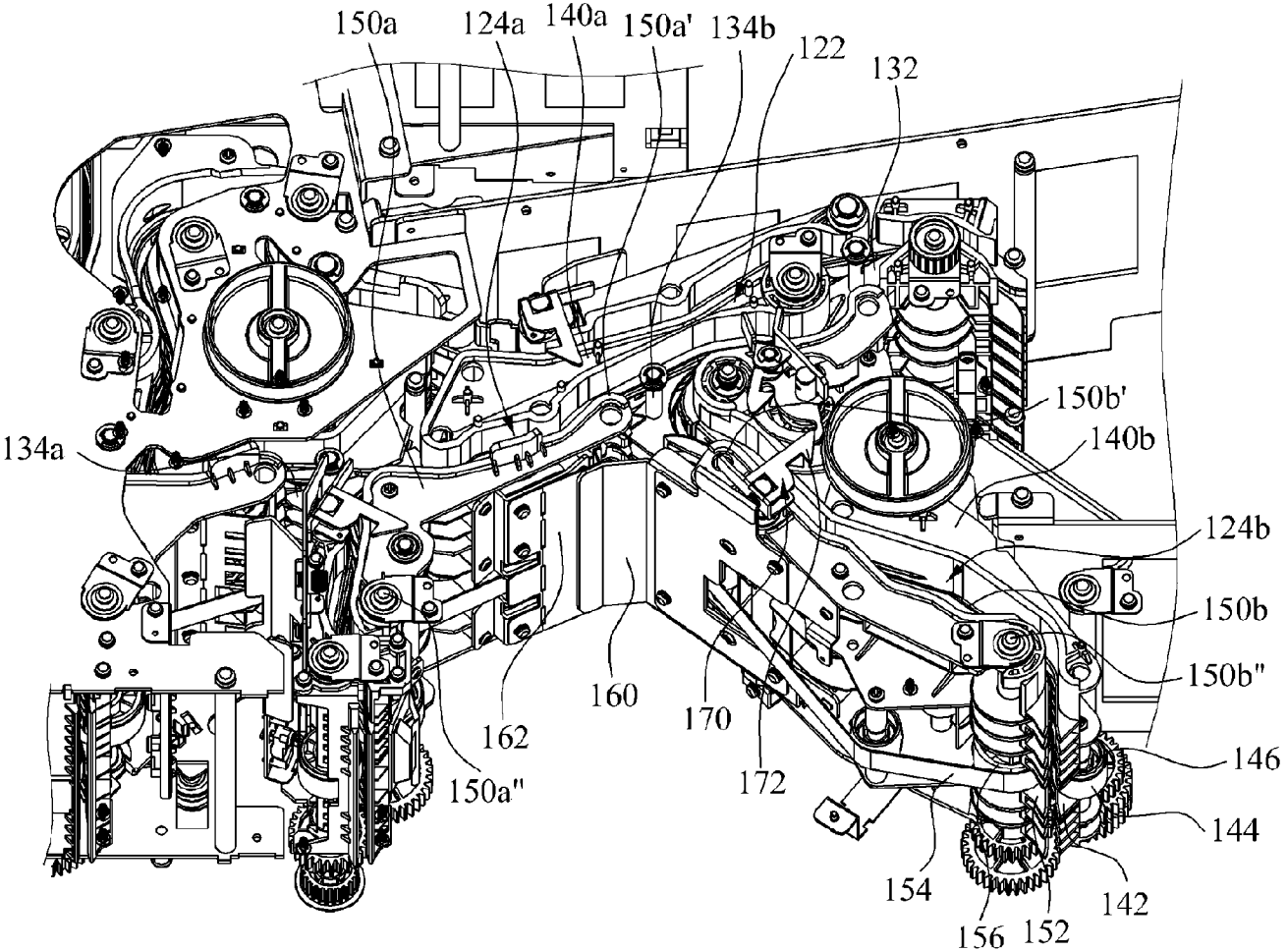
FIG. 4 is a side view illustrating second transfer portions of FIG. 3.

FIG. 1 is a sectional view illustrating a depositing device 100 of an ATM including a media transfer device according to an embodiment of the present invention, FIG. 2 is a view illustrating a media transfer path of FIG. 1, FIG. 3 is a perspective view illustrating major components of the ATM of FIG. 1, and FIG. 4 is a side view illustrating second transfer portions of FIG. 3.

Referring to FIG. 1, the depositing device 100 of the ATM may include a housing 102 forming an external appearance, a deposit apparatus 104 being disposed in an upper portion of the housing 102 to receive paper media of a customer, a determination apparatus 106 to determine whether the paper media received in the deposit apparatus 104 is normal or abnormal, a reject apparatus 108 to return, to the customer, paper media that is determined as abnormal paper media by the determination apparatus 106, an escrow apparatus 110 to temporarily store paper media that is determined as normal paper media by the determination apparatus 106, and a storage apparatus 112 to receive the paper media that is temporarily stored in the escrow apparatus 110.

An inlet of the deposit apparatus 104 may be disposed on a front surface of the ATM. The deposit apparatus 104 may receive paper media of the customer based on a bundle unit and transfer the paper media to the determination apparatus 106 based on a sheet unit.

To determine whether the paper media transferred from the deposit apparatus 104 is normal or abnormal, the determination apparatus 106 may include various types of sensors, an image scanner, a magnetic ink character recognition (MICR) means, and the like. The determination apparatus 106 may function to determine paper media in an abnormal state, for example, torn paper media, a plurality of overlapped paper media, partially folded paper media, and the like, and may also function to determine forged paper media.

The reject apparatus 108 may correspond to an apparatus for receiving the paper media that is determined as abnormal paper media by the determination apparatus 106, temporarily storing the paper media, and then returning the temporarily stored paper media to the deposit apparatus 104. Accordingly, since the abnormal paper media injected in the deposit apparatus 104 by means of the determination apparatus 106 and the reject apparatus 108 is transferred again to the customer, it is possible to secure stability and reliability of the ATM.

The escrow apparatus 110 may correspond to an apparatus for receiving paper media that is determined as normal paper media by the determination apparatus 106, temporarily storing the normal paper media and then, transferring the temporarily stored paper media to the storage apparatus 112. This is because when the escrow apparatus 110 collects paper media transferred based on a sheet unit and processes paper media based on a bundle unit, it is possible to increase the deposit processing efficiency. The escrow apparatus 110 may store paper media in a form to be wound around a drum (not shown) and a band (not shown), instead of storing the paper media in a stacked form.

The storage apparatus 112 may include cassettes 112*a* and 112*b* receiving the paper media temporarily stored in the escrow apparatus 110 to internally store the same. The cassettes 112*a* and 112*b* may be attachably and detachably mounted in a lower portion of the housing 102. Even though the storage apparatus 112 may provide a plurality of cassettes, for example, the cassettes 112*a* and 112*b*, the present embodiment will be described based on an example in which two cassettes 112*a* and 112*b* are provided in the depositing device 100. That is, when the first cassette 112*a* is fully filled up with paper media by initially filling paper media in the first cassette 112*a*, paper media may start filling in the second cassette 112*b*.

Referring to FIG. 1, the depositing device 100 may further include a retract apparatus 114 to retract uncollected paper media when paper media returned to the deposit apparatus 104 is not collected by the customer for at least a predetermined period of time, and a forged paper media storage apparatus 116 to store paper media that is determined as forged paper media by the determination apparatus 106.

When the paper media returned to the deposit apparatus 104 through the reject apparatus 108 is not collected for a predetermined period of time, the retract apparatus 114 may retract paper media within the deposit apparatus 104 and keep the retracted paper media.

That is, when the customer does not input a separate processing command after depositing paper media in the deposit apparatus 104, an operation of the depositing device 100 may not further progress and in this state, be left as is for a relatively long period of time. Accordingly, after returning, to the customer through the reject apparatus 108, the paper media stored in the escrow apparatus 110, the depositing device 100 may cancel depositing of the returned paper media. Also, after returning, to the customer through the reject apparatus 108, even paper media determined as abnormal paper media by the determination apparatus 106, the depositing device 100 may cancel depositing of the returned paper media.

When the costumer does not collect the paper media returned to the deposit apparatus 104 using the reject apparatus 108 for at least a predetermined period of time, the operation of the depositing device 100 may not further progress. In addition, there is a probability that the paper media returned to the deposit apparatus 104 may be missed. Accordingly, when a special situation that the paper media returned to the deposit apparatus 104 is left as is for the at least a predetermined period of time, the paper media may be transferred from the deposit apparatus 104 to the retract apparatus 114 and the retract apparatus 114 may keep the transferred paper media.

The forged paper media storage apparatus 116 may correspond to an apparatus for retracting paper media that is determined as forged paper media by the determination apparatus 106 to thereby prevent the distribution of the forged paper media. That is, unlike paper media that is determined as other abnormal paper media by the determination apparatus 106, the forged paper media may have malicious effect on the economy and thus, it may be advantageous to the national economy to retract the forged paper media instead of returning the forged paper media to the customer. Accordingly, when the paper media is determined to be forged by the determination apparatus 106, the depositing device 100 may forcefully retract the forged paper media to the forged paper media storage apparatus 116.

Meanwhile, a circumstance where paper media is to be stored in the retract apparatus 114 and the forged paper media storage apparatus 116 does not frequently occur and limitedly occurs in a special situation. Accordingly, the retract apparatus 114 and the forged paper media storage apparatus 116 may be formed to have a relatively small capacity compared to the cassettes 112*a* and 112*b*. According to the present embodiment, the retract apparatus 114 and the forged paper media storage apparatus 116 may be formed in a single box.

Referring to FIG. 1 and FIG. 2, the depositing device 100 of the ATM according to an embodiment of the present invention may further include media transfer devices 120, 122, 124, and 126 being disposed among the deposit apparatus 104, the determination apparatus 106, the reject apparatus 108, the escrow apparatus 110, the storage apparatus 112, the retract apparatus 114, and the forged paper media storage apparatus 116 to form media transfer paths 121, 123, 125*a*, 125*b*, and 127.

The media transfer devices 120, 122, 124, and 126 may be classified into a deposit transfer apparatus 120 being provided among the deposit apparatus 104, the determination apparatus 106, and the reject apparatus 108 to form the deposit transfer path 121 through which paper media is deposited or returned, an escrow transfer device 122 being provided between the deposit transfer apparatus 120 and the escrow apparatus 110 to form an escrow transfer path 123 for temporarily storing paper media, a storage transfer apparatus 124 being provided between the escrow transfer apparatus 122 and the storage apparatus 112 to form storage transfer paths 125*a* and 125*b* for storing paper media, and a specific transfer apparatus 126 being provided among the deposit transfer apparatus 120, the escrow transfer apparatus 122, the retract apparatus 114, and the forged paper media storage apparatus 116 to form a specific transfer path 127 through which paper media is to be retracted.

The deposit transfer apparatus 120 may transfer, to the determination apparatus 106, paper media deposited in the deposit apparatus 104, may transfer, to the escrow transfer apparatus 122, paper media that is determined as normal paper media by the determination apparatus 106, and may transfer, to the reject apparatus 108, paper media that is determined as abnormal paper media by the determination apparatus 106. Here, the deposit transfer apparatus 120 and the escrow transfer apparatus 122 may be connected to partially share the deposit transfer path 121 and the escrow transfer path 123. Also, a deposit gate 130 for selectively transferring paper media to the escrow transfer apparatus 122 and the reject apparatus 108 depending on the determination result of the determination apparatus 106 may be disposed in a connection portion between the deposit transfer apparatus 120 and the escrow transfer apparatus 122.

The escrow transfer apparatus 122 may transfer, to the escrow apparatus 110, normal paper media transferred from the deposit transfer apparatus 120, and may transfer paper media temporarily stored in the escrow apparatus 110 to the storage transfer apparatus 124, the specific transfer apparatus 126, and the deposit transfer apparatus 120. An escrow gate 132 for selective entering or exiting of paper media with respect to the escrow apparatus 110 may be disposed in a connection portion between the escrow transfer apparatus 122 and the escrow apparatus 110.

The storage transfer apparatus 124 may transfer, to the storage apparatus 112, paper media transferred from the escrow transfer apparatus 122. In this instance, the storage apparatus 112 may include the first cassette 112*a* and the second cassette 112*b* and thus, the storage transfer apparatus 124 may include a first storage transfer apparatus 124*a* and a second storage transfer apparatus 124*b*. The first storage transfer apparatus 124*a* and the escrow transfer apparatus 122 may be connected to each other in a structure to partially share the first storage transfer path 125*a* and the escrow transfer path 13. The second storage transfer apparatus 124*b* and the escrow transfer apparatus 122 may be connected to each other in a structure to partially share the second storage transfer path 125*b* and the escrow transfer path 123. A first storage gate 134*a* for selectively transferring paper media to the first cassette 112*a* may be disposed in a connection portion between the first storage transfer apparatus 124*a* and the escrow transfer apparatus 122. A second storage gate 134*b* for selectively transferring paper media to the second cassette 112*b* may be disposed in a connection portion between the second storage transfer apparatus 124*b* and the escrow transfer apparatus 122.

The specific transfer apparatus 126 may transfer, to the forged paper media storage apparatus 116, paper media that is determined as forged paper media by the determination apparatus 106, and may transfer, to the retract apparatus 114, paper media that is uncollected by the customer from the deposit apparatus 104. Here, the specific transfer apparatus 126 and the deposit transfer apparatus 120 may be connected to each other in a structure to partially share the specific transfer path 127 and the deposit transfer path 121. The specific transfer apparatus 126 and the escrow transfer apparatus 122 may be connected to each other in a structure to partially share the specific transfer path 127 and the escrow transfer path 123. Also, a forged paper media gate 136 for selectively transferring forged paper media to the forged paper media storage apparatus 116 depending on the determination result of the determination apparatus 106 may be disposed in a connection portion between the specific transfer apparatus 126 and the deposit transfer apparatus 120. A retract gate 138 for selectively transferring paper media to the retract apparatus 114 may be disposed in a connection portion between the specific transfer apparatus 126 and the escrow transfer apparatus 122.

In the meantime, a specific gate 139 for selectively transferring paper media of the specific transfer apparatus 126 to the forged paper media storage apparatus 116 and the retract apparatus 114 may be disposed among the specific transfer apparatus 126, the forged paper media storage apparatus 116, and the retract apparatus 114.

Referring to FIG. 1 through FIG. 3, the media transfer devices 120, 122, 124, and 126 according to an embodiment of the present invention may include first transfer portions 140 transferably supporting one surface of paper media, and second transfer portions 150 being disposed to face the first transfer portions 140, to transferably support another surface of paper media and to form media transfer paths 121, 123, 125*a*, 125*b*, and 127 in a space with the first transfer portions 140, respectively.

The first transfer portion 140 may include a first transfer frame 142 being mounted to the housing 102, a first transfer belt 144 being mounted to the first transfer frame 142 to be rotatable in one direction to closely contact with one surface of paper media, and a first transfer roller 146 being rotatably mounted to the first transfer frame 142 to support or drive the first transfer belt 144.

The second transfer portion 150 may include a second transfer frame 152 being mounted to the housing 102 to face the first transfer frame 142, a second transfer belt 154 being mounted to the second transfer frame 154 to be rotatable in another direction and to closely contact with another surface of paper media, and a second transfer roller 156 being rotatably mounted to the second transfer frame 152 to support or drive the second transfer belt 154.

Accordingly, paper media may be fixed by a holding force of the first transfer belts 144 and the second transfer belts 154, and the first transfer belts 144 and the second transfer belts 154 may rotate by a drive force of the first transfer rollers 146 and the second transfer rollers 156, whereby the paper media may be transferred.

In the meantime, to remove jammed paper media, the media transfer device 120, 122, 124, or 126 may selectively open or close a portion of the media transfer paths 121, 123, 125*a*, 125*b*, and 127 while rotating a portion of the second transfer portions 150. The second portions 150 may be provided to each of portions having a relatively high jam occurrence probability in the media transfer devices 120, 122, 124, and 126. For example, portions where the deposit transfer apparatus 120, the escrow transfer apparatus 122, the first storage transfer apparatus 124*a*, the second storage transfer apparatus 124*b*, and the specific transfer apparatus 126 are connected to other components may correspond to the portions having the relatively high jam occurrence probability in the media transfer devices 120, 122, 124, and 126. Hereinafter, for ease of description, in the present embodiment, only a second transfer portion 150*a* provided between the escrow transfer apparatus 122 and the first storage transfer apparatus 124*a* and a second transfer portion 150*b* provided between the escrow transfer apparatus 122 and the second storage transfer apparatus 124*b* will be described. However, the second transfer portions 150*a* and 150*b* may be provided to other portions of the media transfer devices 120, 122, 124, and 126 in the same or similar structure.

At least two of the second transfer portions 150, for example, the second transfer portions 150*a* and 150*b* may be disposed to be adjacent to each other. One ends 150*a*' and 150*b*' of the at least two second transfer portions 150*a* and 150*b* disposed to be adjacent to each other may be disposed to be rotatable based on another ends 150*a*" and 150*b*" thereof. Hereinafter, for ease of description, the second transfer portions 150*a* and 150*b* are formed as two second transfer portions 150, however, may be formed as at least three second transfer portions.

Accordingly, when the second transfer portions 150*a* and 150*b* rotate based on the other ends 150*a*" and 150*b*", a portion of the media transfer paths 123, 125*a*, and 125*b* may open and thus, it is possible to accurately verify a jamming portion with bare eyes, and to readily remove jammed paper media.

Referring to FIG. 1 through FIG. 4, the media transfer device 120, 122, 124, or 126 according to an embodiment of the present invention may further include an interoperation portion 160 being interaction-ably provided to the second transfer portions 150*a* and 150*b* so that the second transfer portions 150*a* and 150*b* may be opened and closed together, and a locking portion 170 being mounted to one of the second transfer portions 150*a* and 150*b* to be stopped by the housing 102 and thereby be fixed when the media transfer path 123, 125*a*, or 125*b* is closed.

The interoperation portion 160 may be provided to the one ends 150*a*' and 150*b*' of the second transfer portions 150*a* and 150*b*. One end of the interoperation portion 160 may be fixed to the one end 150*b*' of the second transfer portion 150*b* including the locking portion 170 among the second transfer portions 150, and another end of the interoperation portion 160 may be formed to interfere with the one end 150*a*' of the second transfer portion 150*a* not including the locking portion 170 among the second transfer portions 150. In particular, when rotating the one ends 150*a*' and 150*b*' of the second transfer portions 150*a* and 150*b* into a direction in which the second transfer portions 150*a* and 15*b* are to become close to the first transfer portion 140, the other end of the interoperation portion 160 may be formed in the one end 150*b*' of the second transfer portion 150*b* to be stopped thereby. The interoperation portion 160 may include a member in a shape of a plate, a rod, a pipe, or a bar formed of a material with an excellent rigidity. The present embodiment will be described based on an example in which a metal plate is used for the interoperation portion 160.

Accordingly, when the one end 150*b*' of the second transfer portion 150*b* including the locking portion 170 rotates into the direction of closing the open portion of the media transfer paths 123, 125*a*, and 125*b*, the one end 150*a*' of the second transfer portion 150*a* not including the locking portion 170 may be forced to rotate in the same direction by another end of the interoperation portion 160. Specifically, even though only one of the second transfer portions 150*a* and 150*b* is opened and closed by the interoperation portion 160, another one of the second transfer portions 150*a* and 150*b* may also be simultaneously opened and closed.

The other end of the interoperation portion 160 may be curved at a predetermined angle in its middle to stably make a sideface contact with the one end 150W of the second transfer portion 150*b*. That is, one of curved surfaces formed on the other end of the interoperation portion 160 may closely contact with the one end 150*b*' of the second transfer portion 150*b* when the media transfer paths 123, 125*a*, and 125*b* are closed. Another one of the curved surfaces formed on the other end of the interoperation portion 160 may closely contact with the one end 150*b*' of the second transfer portion 150*b* when the media transfer paths 123, 125*a*, and 125*b* are open.

Also, an elastic member 162 being elastically deformed when the second transfer portions 150 rotate into the direction of closing the open portion of the media transfer paths 123, 125*a*, and 125*b* may be disposed between the one end 150*a*' of the second transfer portion 150*a* not including the locking portion 170 and the other end of the interoperation portion 160. Even though a coil spring, a pan spring, a pad of elastic material, and the like, may be used for the elastic member 162, the present embodiment will be described based on an example in which the pan spring is used for the one end 150*a*' of the second transfer portion 150*a*.

When rotating the second transfer portions 150*a* and 150*b* into the direction opposite to the direction of opening the media transfer path 123, 125*a*, or 125*b*, the elastic member 162 may be formed to have a size enough to interfere with the other end of the interoperation portion 160 and the one end 150*a*' of the second transfer portion 150*a*. Accordingly, the other end of the interoperation portion 160 and the one end 150*a*' of the second transfer portion 150*a* may not be damaged due to buffering action of the elastic member 162 while opening and closing the media transfer paths 123, 125*a*, and 125*b*. Also, the elastic member may prevent a gap from occurring when the media transfer paths 123, 125*a*, and 125*b* are closed.

The one end of the locking portion 170 may be elastically rotatably connected to one of the second transfer portions 150*a* and 150*b*, and the other end of the locking portion 170 may include a stopping hook 172 being stopped by a stopping protrusion 174 and thereby fixed.

The stopping protrusion 174 may be formed in all the members of the depositing device 100 capable of supporting the second transfer portions 150*a* and 150*b*. For example, the stopping protrusion 174 may be formed in first transfer portions 140*a* and 140*b* being disposed to face the second transfer portions 150*a* and 150*b*, and may also be formed in the housing 102 corresponding to the locking portion 170. Also, a structure of stopping the stopping hook 172 may include, for example, a stopping groove, a stopping hole, and the like, in addition to the stopping protrusion 174. Hereinafter, the present embodiment will be described based on an example in which the stopping protrusion 174 is formed in the housing 102 in a protruded form.

Specifically, when the second transfer portions 150*a* and 150*b* rotate into the direction opposite to the direction of opening the media transfer paths 123, 125*a*, and 125*b*, the stopping hook 172 and the stopping protrusion 174 may interfere with each other whereby the locking portion 170 may elastically rotate. When the second transfer portions 150*a* and 150*b* completely rotate, the stopping hook 172 may be stopped by the stopping protrusion 174 whereby the locking portion 170 may elastically return to its original position. As described above, since the stopping hook 172 of the locking portion 170 is stopped by the stopping protrusion 174 and thereby fixed with a simple operation of rotating the second transfer portions 150*a* and 150*b*, the locking portion 170 may be conveniently used.

On the other hand, when rotating the locking portion 170 into a direction in which the stopping hook 170 is to be separated from the stopping protrusion 174, the second transfer portions 150*a* and 15*b* may rotate into the direction of opening the media transfer paths 123, 125*a*, and 125*b* by the tension of the transfer belts 144 and 154 mounted to the first transfer portions 140 and the second transfer portions 150, and by the elastic force of the elastic member 162. Meanwhile, the locking portion 170 is not limited to the aforementioned structure and thus, may employ a variety of structures capable of limiting the opening and closing operation of the second transfer portions 150 for removing the jam.

Figure 5:
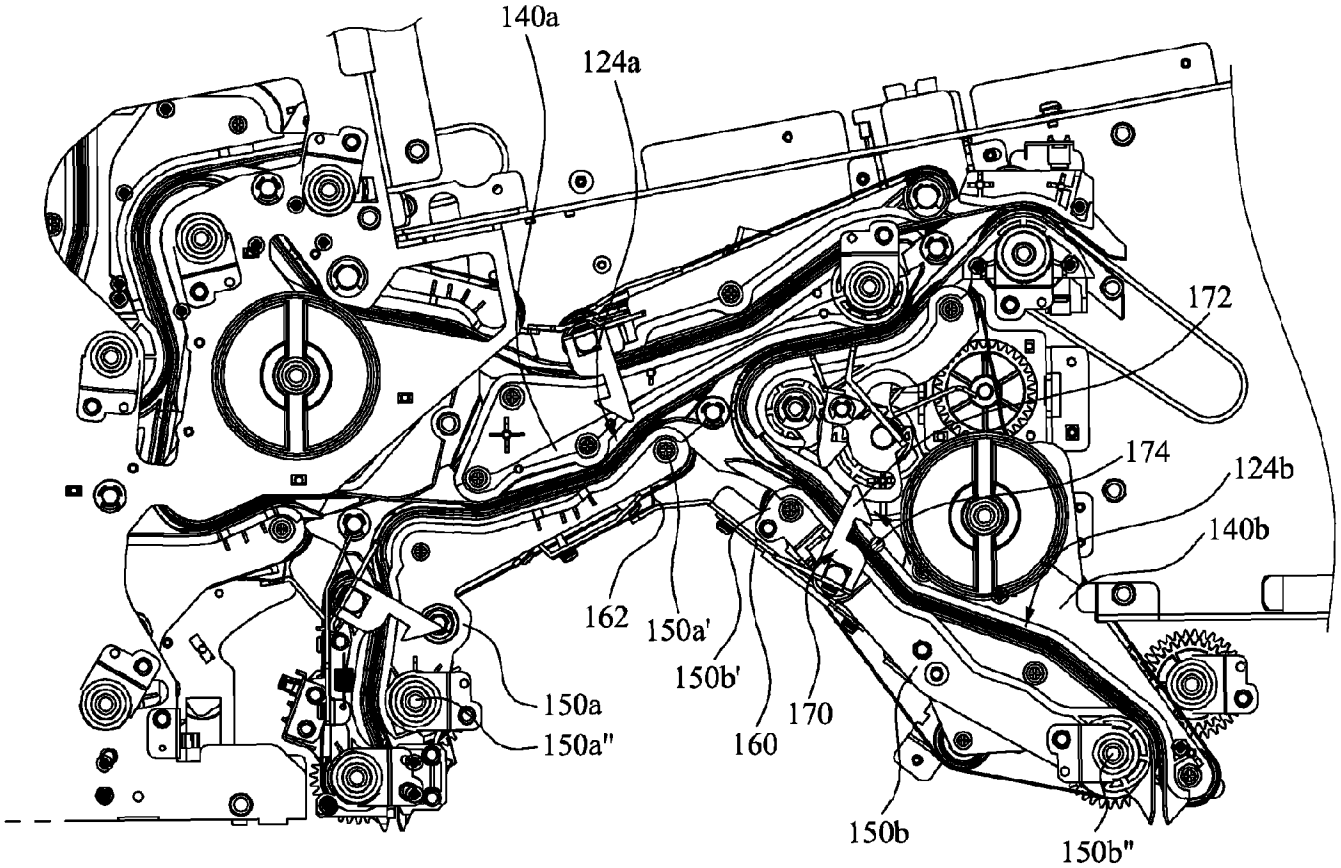
FIG. 5 and FIG. 6 are operation state views sequentially illustrating a process of opening a portion of a media transfer path according to an embodiment of the present invention.
Figure 6:
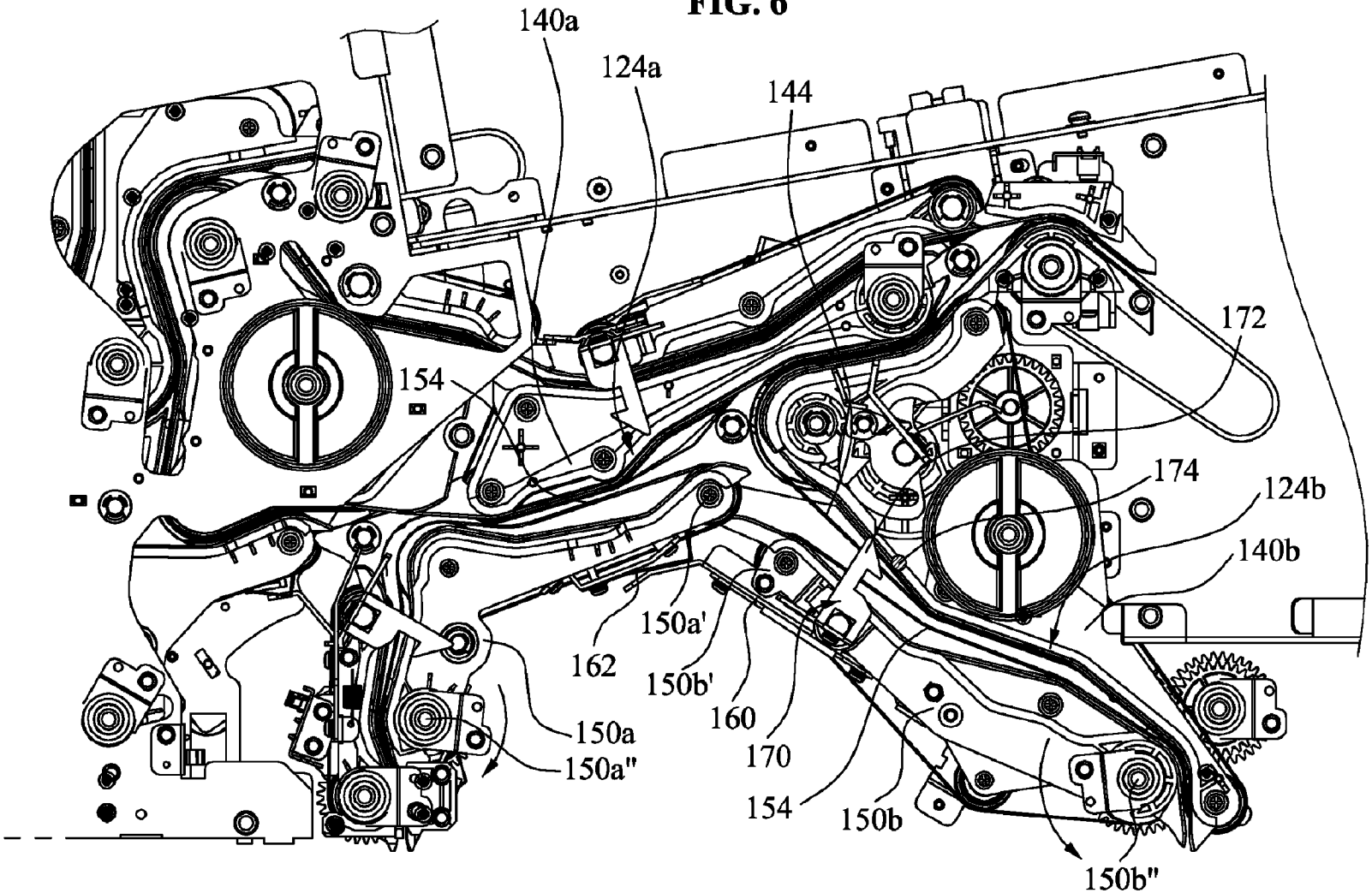

Hereinafter, an operation process and a jam removing method of the media transfer device 120, 122, 124, or 126 according to an embodiment of the present invention constructed as above will be described. FIG. 5 and FIG. 6 are views sequentially illustrating a process of opening a portion of a media transfer path according to an embodiment of the present invention.

The operation process of the media transfer device 120, 122, 124, or 126 will be described. Initially, when a customer inputs paper media in the deposit apparatus 104, the deposit transfer apparatus 120 may transfer the paper media to the determination apparatus 106 based on a sheet unit and the determination apparatus 106 may determine whether the paper media is normal. Paper media determined as forged paper media by the determination apparatus 106 may be transferred from the deposit transfer apparatus 120 to the specific transfer apparatus 126 through the forged paper media gate 136 and then, pass the specific gate 139 and be received in the forged paper media storage apparatus 116.

Paper media determined as normal paper media by the determination apparatus 106 may be transferred from the deposit transfer apparatus 120 to the escrow transfer apparatus 122 through the deposit gate 130, and pass the escrow gate 132 from the escrow transfer apparatus 122 and be temporarily stored in the escrow apparatus 110. Paper media temporarily stored in the escrow apparatus 110 may be transferred to the escrow transfer apparatus 122 through the escrow gate 132, be transferred from the escrow transfer apparatus 122 to the first storage transfer apparatus 124*a* through the first storage gate 134*a*, and be received in the first cassette 112*a* through the first storage transfer apparatus 124*a*. When the first cassette 112*a* is filled up with paper media to its maximum capacity, paper media of the escrow transfer apparatus 122 may be transferred to the second storage transfer apparatus 124 through the second storage gate 134*b* and be received in the second cassette 112*b* through the second storage transfer apparatus 124*b*.

However, when processing of the paper media temporarily stored in the escrow apparatus 110 is delayed for a relatively long period of time, the paper media temporarily stored in the escrow apparatus 110 may be transferred to the reject apparatus 108 through the escrow gate 132, the escrow transfer apparatus 122, and the deposit gate 130. The paper media of the reject apparatus 108 may be returned to the deposit apparatus 104. Also, paper media determined as abnormal paper media by the determination apparatus 106 may be transferred from the deposit transfer apparatus 120 to the reject apparatus 108 through the deposit gate 130. The paper media of the reject apparatus 108 may be returned to the deposit apparatus 104.

When the customer does not collect the paper media returned to the deposit apparatus 104 for at least a predetermined period of time, the paper media may be retracted to the escrow apparatus 110 through the deposit transfer apparatus 120, the deposit gate 130, the escrow transfer apparatus 122, and the escrow gate 132. The paper media retracted in the escrow apparatus 110 may be received in the retract apparatus 114 through the escrow gate 132, the escrow transfer apparatus 122, the retract gate 138, the specific transfer apparatus 126, and the specific gate 139.

When a jam occurs during the aforementioned process of transferring paper media in the media transfer device 120, 122, 124, or 126, an operation of the media transfer device 120, 122, 124, or 126 may be suspended, which results in suspending a depositing function of the depositing device 100. Accordingly, to quickly remove the jam in the media transfer device 120, 122, 124, or 126, thereby quickly recovering the function of the depositing device 100 may become an important issue in the efficiency aspect.

Hereinafter, a method of removing the jam in the media transfer device 120, 122, 124, or 126 will be described. After opening the media transfer path 121, 123, 125*a*, 125*b*, or 127 by rotating the portion of the second transfer portion 150 disposed in the media transfer device 120, 122, 124, or 126, and after verifying the jamming portion in the media transfer path 121, 123, 125*a*, 125*b*, or 127 with bare eyes, jammed paper media may be removed from the media transfer path 121, 123, 125*a*, 125*b*, or 127.

Hereinafter, for ease of description, detailed description will be made based on the second transfer portions 150*a* and 150*b* disposed in the connection portions of the escrow transfer apparatus 122, and the first storage transfer apparatus 124*a*, and the second storage transfer apparatus 124*b*.

Referring to FIG. 5 and FIG. 6, the stopping hook 172 may be separated from the stopping protrusion 174 by rotating the locking portion 170. Then, due to the tension of the transfer belts 144 and 154 mounted to the first transfer portions 140 and the second transfer portions 150 and the repulsive force of the elastic member 162, the second transfer portions 150 for jam removal may rotate into the direction of opening the media transfer paths 123, 125*a*, and 125*b*.

When the connection portion of the media transfer paths 123, 125*a*, and 125*b*, that is, the escrow transfer path 123, the first storage transfer path 125*a*, and the second storage transfer path 125*b* is open, it is possible to verify whether jam has occurred in the media transfer paths 123, 125*a*, and 125*b* with bare eyes. When the jam occurs in the media transfer paths 123, 125*a*, and 125*b*, it is possible to put a hand and pull out jammed paper media.

When the jam is removed in the media transfer device 120, 122, 124, or 126, the second transfer portion 150*a* including the locking portion 170 among the second transfer portions 150*a* and 150*b* may rotate again into the direction opposite to the direction of opening the media transfer paths 123, 125*a*, and 125*b*. In this case, the interoperation portion 160 fixed to the one end 150W of the second transfer portion 150*b* may rotate together, and the one end 150*a*' of the second transfer portion 150*a* may also rotate together into the opposite direction to the direction of opening the media transfer paths 123, 125*a*, and 125*b* by the end of the interoperation portion 160. Accordingly, with only a simple operation of rotating the second transfer portion 150*b* fixed with the interoperation portion 160, the other second transfer portion 150*a* may also rotate. Accordingly, an operation of opening and closing the media transfer paths 123, 125*a*, and 125*b* by rotating the second transfer portions 150*a* and 15*b* may be more readily performed.

In this instance, the end of the interoperation portion 160 may closely contact with the elastic member 162 mounted to the one end 150*a*' of the second transfer portion 150*a*. Accordingly, when the second transfer portions 150*a* and 150*b* rotate into the direction opposite to the direction of opening the media transfer paths 123, 125*a*, and 125*b*, the elastic member 162 may be elastically pressed by the interoperation portion 160 and the second transfer portion 150*a*. Accordingly, the elastic member 162 may absorb collision between the interoperation portion 160 and the second transfer portion 150*a* and thus, may prevent damage to the interoperation portion 160 and the second transfer portion 150*a*. In addition, the elastic member 162 may elastically support the interoperation portion 160 and the second transfer portion 150*a* and thus, may prevent a gap from occurring between the interoperation portion 160 and the second transfer portion 150*a*.

When the rotation of the second transfer portions 150*a* and 150*b* is completed as above, the locking portion 170 may elastically rotate whereby the stopping hook 172 may be stopped by the stopping protrusion 174 and thereby be fixed. The operation of the second transfer portions 150*a* and 150*b* may be locked by the locking portion 170.

Although a few embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents. That is, the media transfer device of the present invention may be applicable to a media transfer device of a withdrawing device or a depositing and withdrawing device, in addition to the depositing device, and second transfer portions may be respectively formed in a plurality of portions where a jam may highly probably occur.

The invention claimed is:

1. A media transfer device of an automatic teller machine (ATM), the media transfer device comprising:

a first transfer portion abutting one surface of a paper medium;

a plurality of second transfer portions, each of the second transfer portions having a side facing the first transfer portion, wherein at least two of the plurality of second transfer portions are hinged to rotate between an open state where the plurality of the second transfer portions are disengaged from the first transfer portion and a closed state where the plurality of second transfer portions abut the other surface of the paper medium and engage the first transfer portion to transfer the paper medium in conjunction with the first transfer portion;

an interoperation portion between two second transfer portions and configured to move one of the two second transfer portions into the closed state by moving the other of the two second transfer portions into the close state; and a locking portion configured to fix the other of the two second transfer portions in the closed state, the locking portion released to move the one of the two second transfer portions into the open state by moving the other of the two second transfer portions and the interoperation portion into the open state.

2. The media transfer device of claim 1, wherein:

the two of the plurality of second transfer portions are disposed adjacent to each other, and an end of each of the two second transfer portions is rotatable with respect to another end of each of the two second transfer portions, and wherein the interoperation portion is coupled to an end of the other of the two second transfer portions.

3. The media transfer device of claim 2, wherein:

one side of the interoperation portion is fixed to the end of the other of the two second transfer portions, and an opposite side of the interoperation portion pushes one end of the one of the two second transfer portions towards the first transfer portion.

4. The media transfer device of claim 3, wherein an elastic member is disposed between the interoperation portion and the end of the one second transfer portion being pushed by the interoperation portion to provide elastic force in a direction of releasing the one of the two second transfer portions into the open state.

5. The media transfer device of claim 1, wherein:

the first transfer portion and the plurality of second transfer portions comprise at least a transfer belt and a transfer roller, and at least one of the plurality of second transfer portions are configured to rotate into the open state by tension of the transfer belt when the locking portion is released.

6. The media transfer device of claim 1, wherein the locking portion is elastically rotatably mounted to one of the second transfer portions and comprising a stopping hook for engaging a stopping protrusion formed in a housing receiving the first transfer portion and the plurality of second transfer portions.

* * * * *